US005810283A

United States Patent [19]

Shea

[11] Patent Number: 5,810,283

[45] Date of Patent: Sep. 22, 1998

[54] APPARATUS AND METHOD FOR WIRE COIL PAYOFF

[75] Inventor: Patrick Joseph Shea, El Paso, Tex.

[73] Assignee: United Technologies Automotive, Inc., Dearborn, Mich.

[21] Appl. No.: 698,811

[22] Filed: Aug. 16, 1996

[51] Int. Cl.[6] ..... B65H 49/12

[52] U.S. Cl. ..... 242/559.1; 242/128; 242/129

[58] Field of Search ..... 242/559, 559.1, 242/559.3, 128, 129, 129.8, 130, 131

[56] References Cited

U.S. PATENT DOCUMENTS

| | | | |
|---|---|---|---|
| 2,479,826 | 8/1949 | Frick et al. | 242/128 |
| 2,548,248 | 4/1951 | Wiebe | 242/578 |
| 3,021,010 | 2/1962 | McMasters | 242/129 |
| 3,292,877 | 12/1966 | McMasters | 242/129 |
| 3,406,926 | 10/1968 | Washburn | 242/128 |
| 3,425,647 | 2/1969 | Kovaleski et al. | 242/128 |
| 3,667,699 | 6/1972 | Hobbs et al. | 242/129 |
| 3,972,489 | 8/1976 | Kovaleski | 242/128 |
| 3,997,127 | 12/1976 | Kovaleski | 242/128 |
| 4,017,037 | 4/1977 | Kovaleski | 242/128 |
| 4,055,314 | 10/1977 | Kovaleski | 242/128 |
| 4,062,505 | 12/1977 | Kovaleski | 242/128 |
| 4,322,047 | 3/1982 | Bonnabaud | 242/128 |
| 4,508,290 | 4/1985 | Bauer | 242/128 |
| 5,205,508 | 4/1993 | Masera et al. | 242/559.2 |
| 5,275,034 | 1/1994 | Del Fabro et al. | 242/559.2 |

*Primary Examiner*—John P. Darling
*Attorney, Agent, or Firm*—Howard & Howard

[57] ABSTRACT

An improved apparatus and method for dispensing wire includes a shuttle system such that the wire may be rapidly and efficiently changed. In addition, improvements are made to the individual dispensing mounting plates and mandrels to facilitate the changing of the coils, and also to ensure smooth flow of the wire off of the coils.

19 Claims, 6 Drawing Sheets

APPARATUS AND METHOD FOR WIRE COIL PAYOFF

BACKGROUND OF THE INVENTION

This invention relates to a packageless coil payoff device which provides better control of the wire leaving the coil, improved methods for mounting the packageless coil, and also allows shuttling of a new coil into the system once a prior coil has been emptied.

Wire dispensing systems have typically mounted the wire coils on cardboard, plastic or steel spindles. The wire is removed from the coils to machines for cutting or terminating the wire to a desired size. A good deal of waste packaging results from this type of system, such as drums, totes, tubes, reels, bobbins and spools.

In the above described wire handling system, various length pieces of wire are repeatedly removed to a wire cutting machine. As an example, if one is making wire harnesses for vehicles, one would repeatedly be taking relatively various lengths from the wire coil (cycling). This results in repeated acceleration and deceleration of the wire from the coil. It has been difficult to smoothly remove the wire in the prior art.

In addition, one must change from the coil of the particular type of wire being dispensed from time to time. The known systems have not successfully provided the ability to rapidly and efficiently change the type of wire being dispensed.

Known systems address bare wire only, and use continuous payoff. Continuous payoff does not have acceleration and deceleration concerns. Moreover, the prior art does not provide manual handling. There is a need for a system to using a packageless quantity of wire, without drums, totes, tubes, spools, reels, bobbins or core inserts, and which is manually handleable.

Further, the known systems have had difficulty at the end of the wire on a coil. There has been a need for a system that will allow automatic stopping of the system when a coil reaches its end, and then provide efficient changing of the quantity of wire.

SUMMARY OF THE INVENTION

In the disclosed embodiment of this invention, a shuttle system is provided that shuttles a new wire coil into the system when an old coil is depleted. Preferably, a control shuts the system down as the old coil approaches its end, and then allows the new coil to be shuttled into the system. In one embodiment, the shuttle includes a shuttle plate, or carriage, that moves in a plane generally perpendicular to an axis of the coil. The shuttle plate carries two mounting plates.

In another embodiment, the system provides two wire coil mounting plates mounted on a pivoting shuttle plate. A first coil is dispensing while a second coil is available for loading. When one wishes to change the coil, one pivots the plate on the pivot axis such that the old coil moves out of a dispensing location and the new coil moves into the dispensing location.

In other preferred features of this invention, coil mounting plates pivot relative to the shuttle mounting plate. This allows an operator to pivot the mounting plate downwardly such that a new coil may be easily loaded on the plate.

In other features of the invention, a decelerator is provided onto the mounting plate on an opposed side of the coil from the mounting plate. The decelerator preferably includes a plurality of resilient fingers that contact the wire as it is being dispensed. As mentioned above, the wire is repeatedly accelerated and decelerated. The fingers slow the wire on deceleration, thus resulting in smoother flow of the wire from the coil.

In another preferred feature, the decelerator is provided with a rotating flange member. The wire lies on the rotating flange member as the wire is drawn off of the coil. The wire transmits rotation to this rotating flange. Should there be a discontinuity in the coil, such as a wire wrap being caught under an earlier wrap, the rotating flange ensures that the wire will still continue to be dispensed. That is, the rotating flange receives passive energy from the wire when it is properly being dispensed. If there is a problem in dispensing the wire, the rotating energy is then transmitted back to the wire.

In other features of this invention, the mounting plate includes a mandrel with slots at an outer peripheral surface. The wire coil preferably has no core, reel, spool or insert, but instead is wrapped into a coil, and banding tape is placed at several circumferentially spaced locations to retain the coil in shape. The coil is placed on the mandrel and the banding tapes are cut. When one wishes to change the coil, other bands may be moved into the slots in the mandrel and around the coil. The replacement bands are preferably formed of Velcro™.

These and other features of the invention can be best understood from the following specification and drawings, of which the following is a brief description.

DETAILED DESCRIPTION OF PREFERRED EMBODIMENTS

Figure 1:
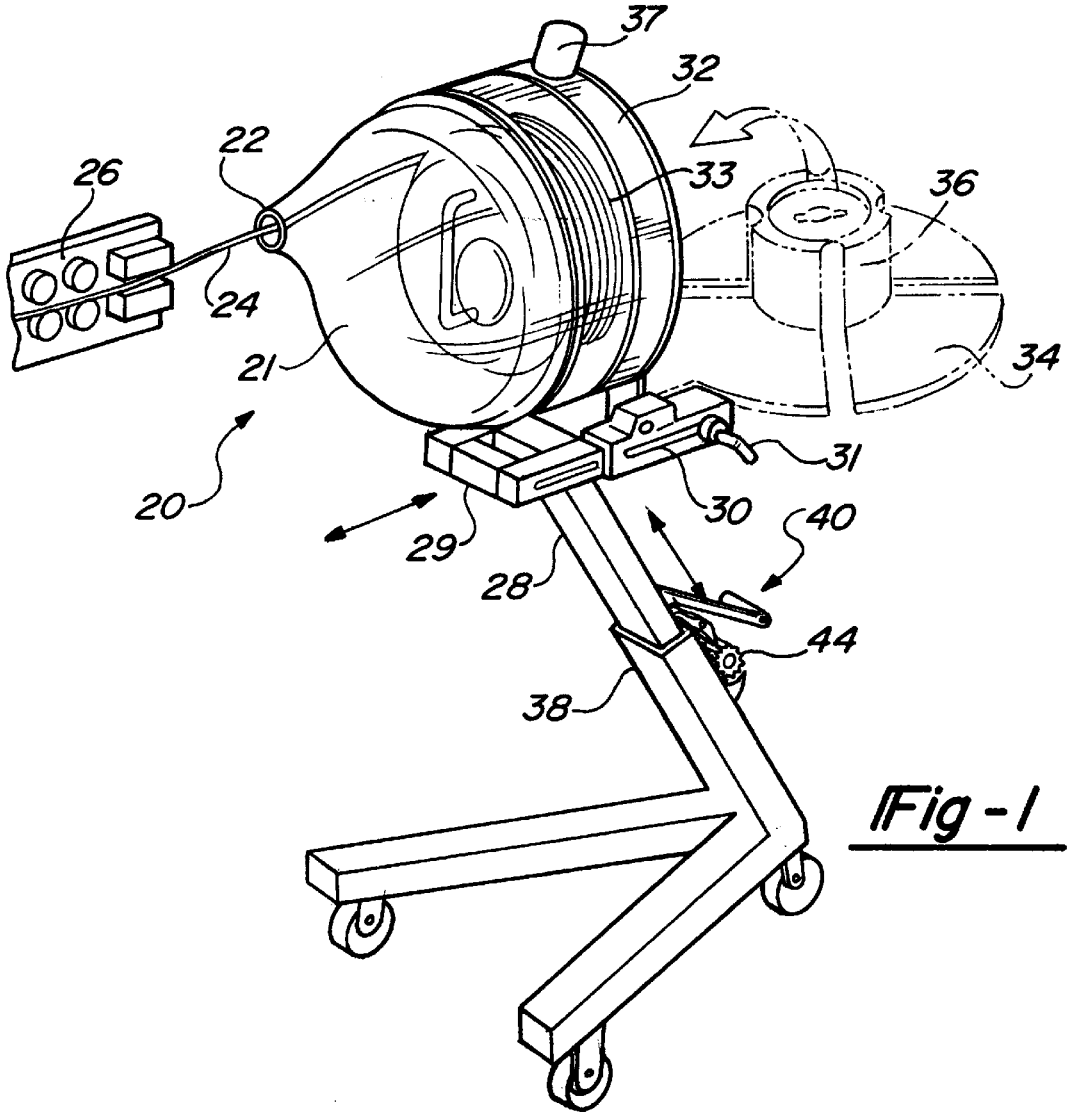
FIG. 1 shows a first embodiment of the present invention.
Figure 1A:
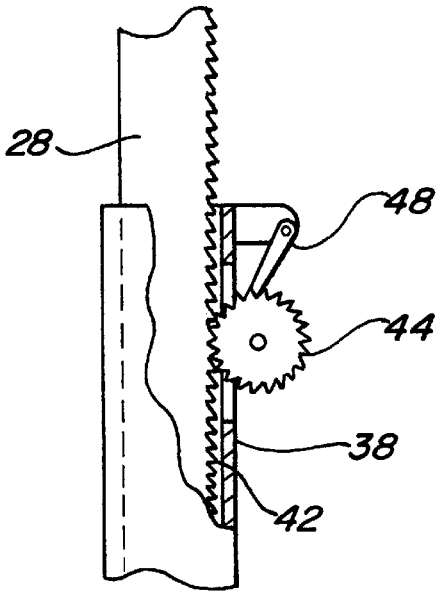

A wire dispensing system 20 is illustrated in FIG. 1. A wire shroud 21 includes an eyelet 22 that dispenses wire 24 to a machine 26. Machine 26 is shown here schematically, but would typically be a wire cutting machine for repeatedly cutting small lengths of wire 24. This type of machine is utilized in cutting and stripping wire for forming wire harnesses, etc. Although the machine 26 is shown spaced from the eyelet 22, it is also within the scope of this invention that the machine be mounted directly to the shroud 21.

The shroud 21 is mounted on a post 28. The post 28 is fixed to a platform 29, and a moving mount portion 30 moves the shroud 21 relative to post 28 forwardly and rearwardly. A handle 31 cranks gearing to move platform 29 relative to platform 29 to achieve this movement.

A mounting plate 32 mounts wire coil 33 within the shroud 21. As shown in phantom at 34, the mounting plate 32 pivots relative to moving mount portion 30 downwardly to a loading position. A mandrel 36 mounts the wire 33. A pin 37 is provided on top of the shroud 21 to hold a decelerator plate when a coil is being loaded onto the mounting plate 32.

A base 38 includes an adjustment structure 40 for adjusting the height of the platform 29, and thus the height of shroud 21. Gear teeth 42 are formed on post 28. A corresponding rotating gear 44 is mounted within base 38. A handle allows rotation of gear 44 to advance gear teeth 42 and thus post 28. A locking flange 48 locks the members once the adjustment is complete.

Figure 2:
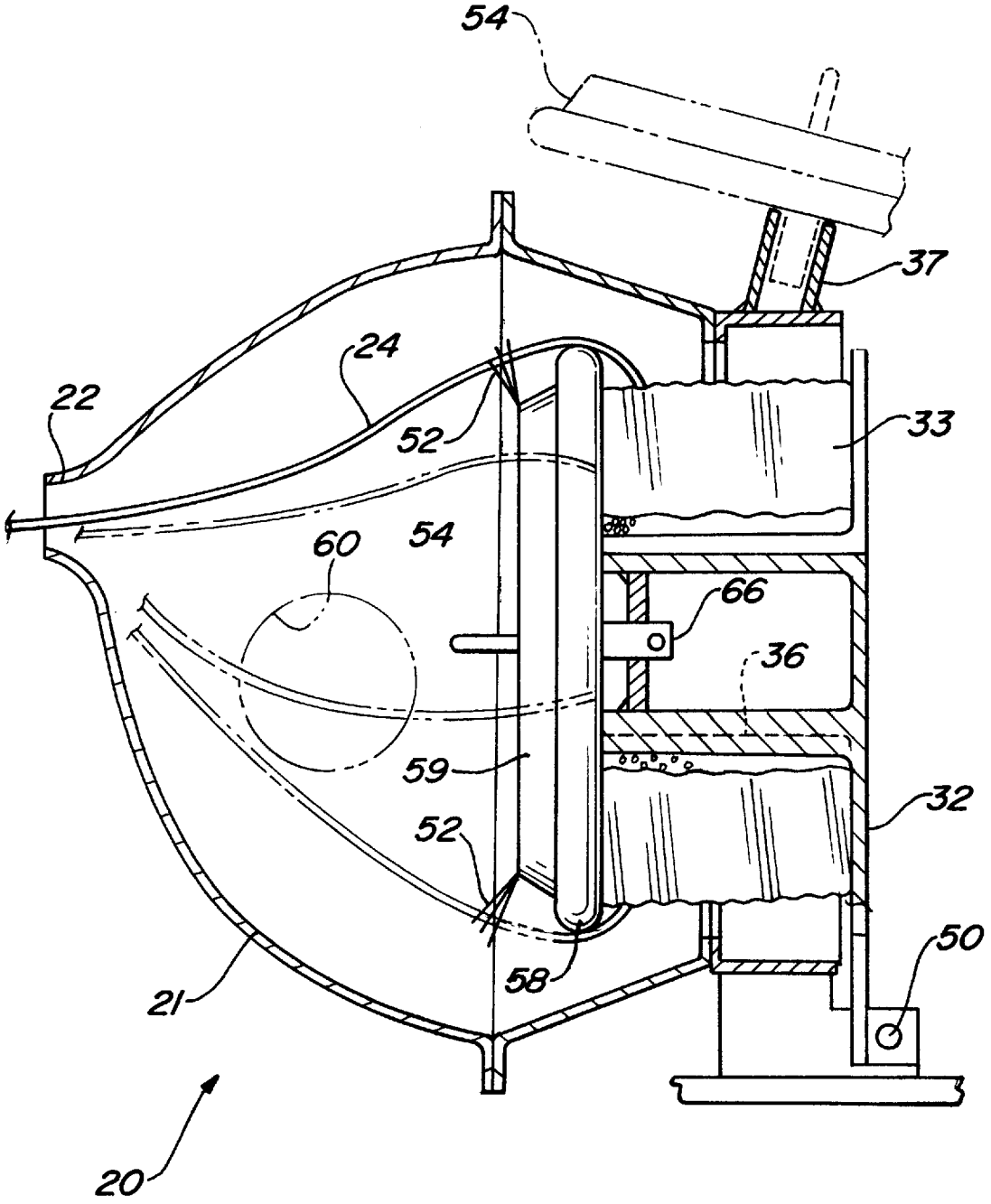
FIG. 2 shows a detail of the first embodiment.

As shown in FIG. 2, a pivot point 50 is provided for mounting plate 32. A decelerator 54 is mounted to a pin 66 within the mandrel 36 to assist in achieving smooth flow of the wire 24 from the coil 33. A rotating flange 58 extends to the outer periphery of the decelerator 54. A plurality of deceleration fingers 52 contact the wire. Members 52 may be plastic monofilament structures. As the wire 24 leaves the coil, it repeatedly hits fingers 52. Fingers 52 decelerate the wire 24 when the wire is no longer being dispensed to a machine. As mentioned above, this invention may be utilized with a type of machine that will repeatedly withdraw relatively small lengths of wire, and then stop. The deceleration fingers 52 assist in stopping the wire when the machine is not pulling additional wire. That is, fingers 52 serve to stop the kinetic energy.

As shown, the wire contacts rotating flange 58. As will be explained below, rotating flange 58 rotates relative to the remainder of decelerator 54. Thus, the wire 24 imparts rotation to the rotating flange 58 as the wire is dispensed. If there is a period in the dispensing of the wire, wherein the coil is poorly wound, and there would otherwise be some difficulty in dispensing the wire, the rotating flange 58 will impart energy to the wire 24 to assist the wire in dispensing through that discontinuity.

The decelerator unit 54 also has a forwardly ramped portion 59 that mounts the deceleration fingers 52. As shown, an opening 60 may be formed in shroud 21 to allow an operator to feed the wire 24 through the eyelet 22. The decelerator 54 is shown mounted on holding pin 37 in phantom. As will be explained below, the mounting plate 32 pivots on pivot point 50 for changing the coils 33. At that time, the decelerator 54 may be maintained on pin 37. In addition, although not shown, the base 38 may be provided with a plurality of racks to hold many different coils.

Figure 3:
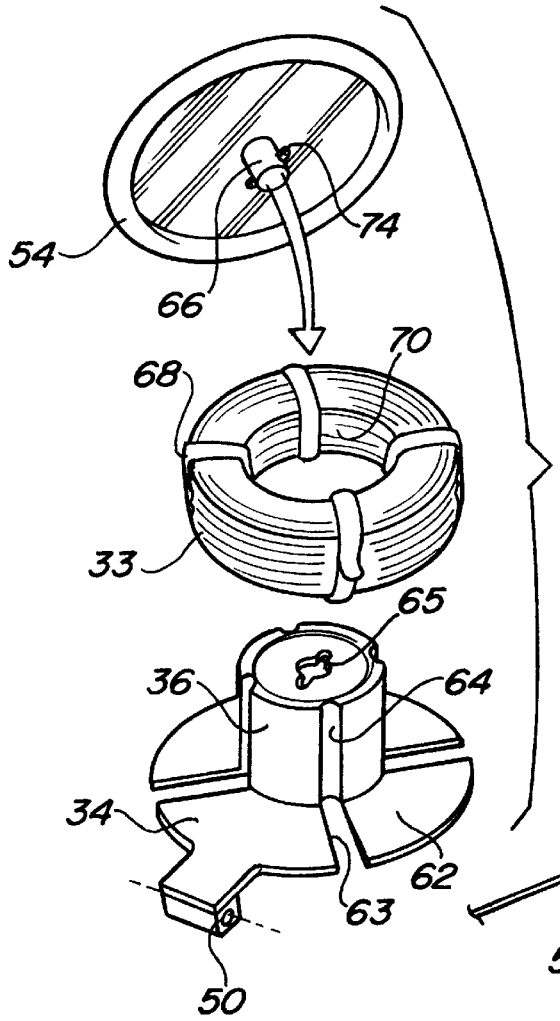
FIG. 3 shows a coil loading feature in the present invention.

FIG. 3 shows a detail of the mounting plate 34 and the decelerator 54. As shown, mandrel 36 includes a plurality of slots 64 at its outer periphery. The slots 64 extend outwardly as shown at 63 to the outer periphery of the backing plate portion 62 of the mounting plate 34. An entry opening 65 at the end of mandrel 36 provides a locking connection for a lock pin 66 and its latch 74 from the decelerator 54. The decelerator moves into the opening 65 with the latch 74 aligned with opening 65. When the decelerator 54 is properly mounted on the mandrel 36, the decelerator 54 is turned such that latch 74 is no longer aligned with the slots in opening 65. This locks the decelerator 54 to the mounting plate 34.

The wire coil 33 is made having bands at circumferentially spaced locations to hold it at its coiled condition. As shown, the inner peripheral bore 70 of the coil 33 does not include any core. The prior art used a good deal of packaging material, including cores. The present invention eliminates that need. The coil 33 is moved onto the mandrel 36, and holding bands are cut. When one wishes to change the coil, one may move Velcro™ strips through the slots 63 and 64 and around the coil 33 as shown at 68. The Velcro™ strips 68 may then be resecured to hold the remainder of the coil in its coiled condition. Although Velcro™ is disclosed, other hook and loop-type fasteners may be substituted. Further, other types of fasteners may be used. This feature facilitates the changing of the coil when a partially dispensed coil needs to be changed to provide a different type of wire. The slots 63 and 64 provide the ability to reband the coil when changed in a partially dispensed condition.

Figure 4:
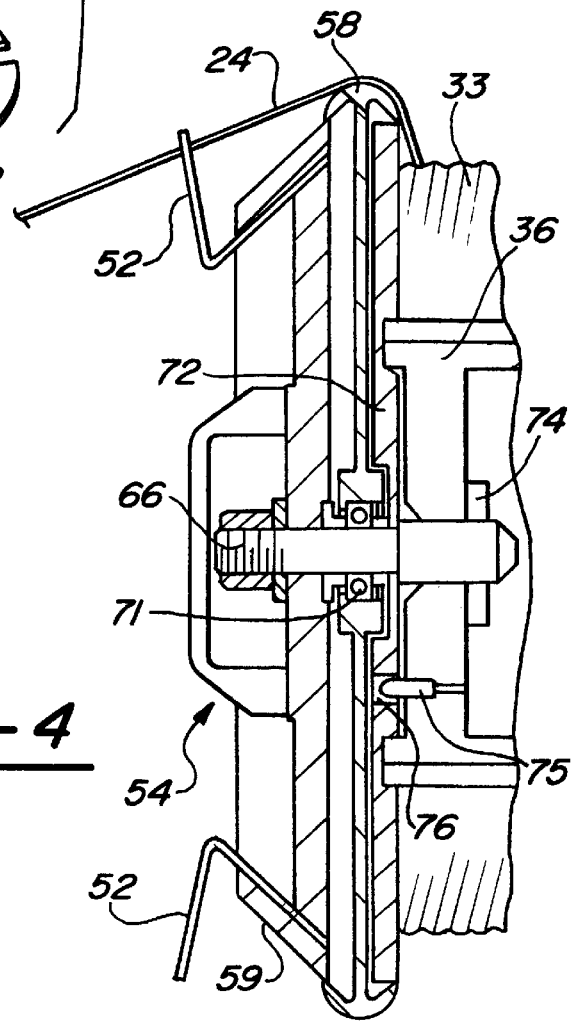
FIG. 4 shows a detail of the mounting wheel for the wire.

FIG. 4 shows a detail of the decelerator 54 having pin 66 locking it to the mandrel 36. The rotating flange 58 is mounted on bearing 71 such that it may rotate on pin 66. A coil separator plate 72 ensures that the coil 33 does not contact the rotating flange 58.

A pin 75 is fixed in a forward end of mandrel 36 and received in a slot 76 in the plate 72. This assists the operator in properly positioning the decelerator 54 on the mandrel 36. The slot 76 preferably extends for a short circumferential distance such that the decelerator 54 may be turned to move the latch 74 to the locked position.

Figure 5:
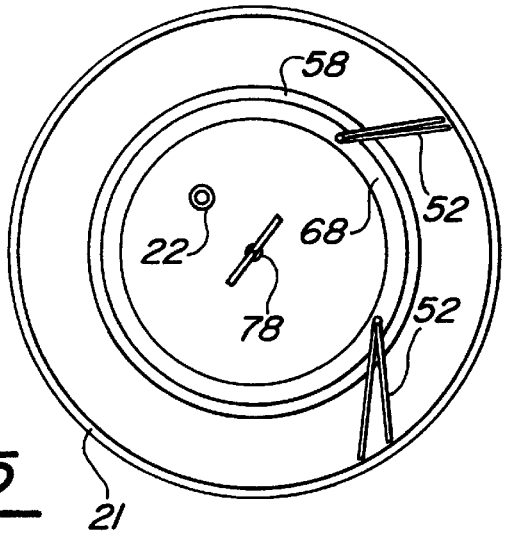
FIG. 5 is an end view of the FIG. 1 embodiment.

FIG. 5 is an end view of the system shown in FIG. 1. As shown, the deceleration fingers 52 are formed at least two circumferentially spaced locations. Preferably, wire pays off of this coil in a clockwise direction. If this is the case, then the left-hand side of the coil shown in this Figure is the "energy " side. Along this side, the wire dispensing must overcome gravity. On the right-hand side of this Figure, the system has a "non-energy " side. Along this side, the wire falls due to the force of gravity. The system including the deceleration fingers 52 and the rotating flange 58 assist in providing smooth flow to overcome any local interruptions in the flow due to poor coiling or gravity. In addition, the eyelet 22 is formed approximately at 10:30, relative to the central axis 78 of the coil and shroud. This positioning assists the wire in overcoming the force of gravity. That is, with the eyelet 22, positioned as shown, the wire will be leaving the coil at an angular location such that the forces of gravity are effectively balanced between the two sides of the system.

Figure 6:
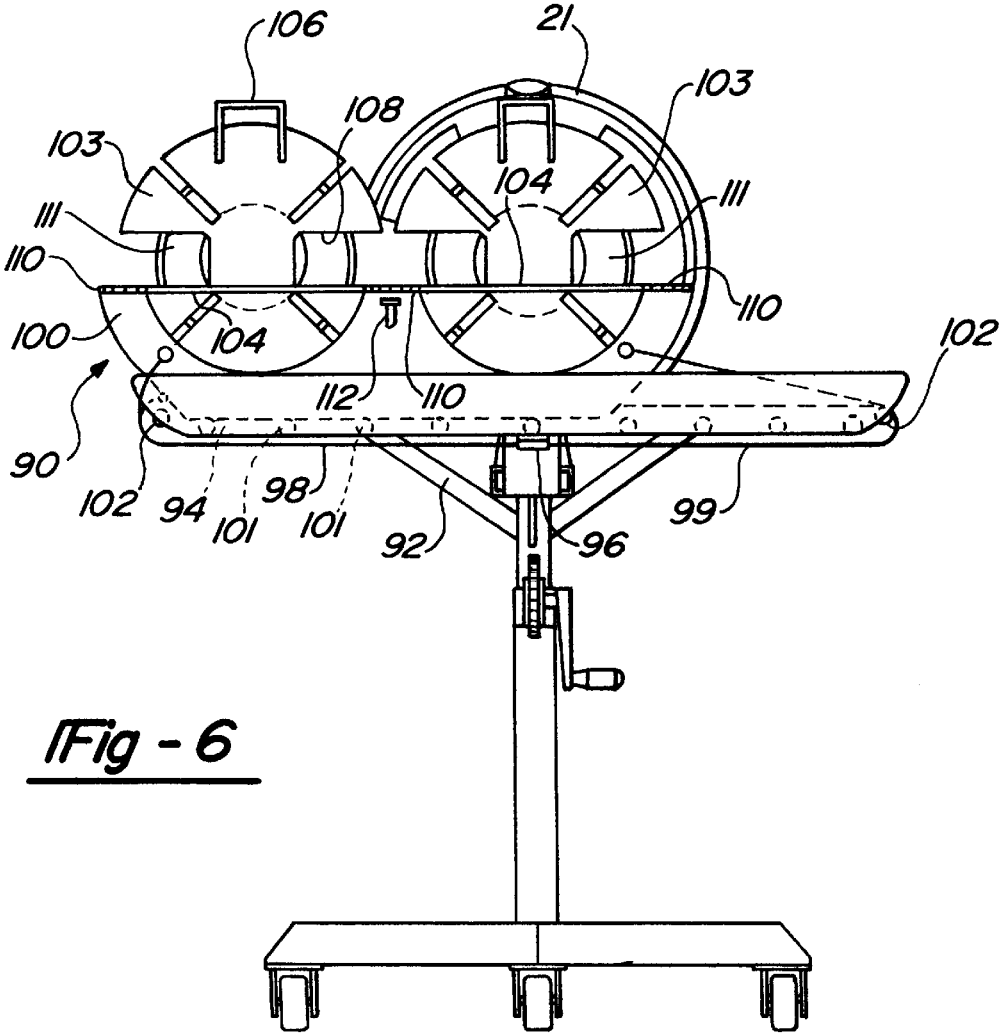
FIG. 6 shows a subsequent embodiment.

FIG. 6 shows another embodiment 90 of the system. A base 92 mounts a track 94. A pulley 96 mounts cables 98 and 99 which are fixed to opposed sides of a carriage 100. Guide rollers 102 are fixed within the track 94 at opposed ends. The cables 98 and 99 rotate on the guide rollers 102. A plurality of rollers 101 are also fixed within the track 94. Carriage 100 rolls along the rollers 101. Carriage 100 mounts two mounting plates 103. Each of the mounting plates includes a pivot rod 104 mounted within the carriage 100. Handles 106 assist in pivoting the mounting plate 103 on rods 104. Slots 108 are formed in the mounting plates 103, such that the mounting plates 103 may pivot on the hinge pivot axis 110 in the carriage 100. The carriage 100 moves into the slot 108 such that the mounting plate 103 may be pivoted downwardly. That is, the slots 108 move over the carriage top portion and hinge 110 when plate 103 is pivoted. A coil 111 is mounted on the mounting plate 103 in a manner similar to that discussed above, with the decelerator and other structure.

As shown, the right-hand mounting plate 103 is aligned with the shroud 21. The right-hand mounting plate 103 and its associated wire coil 111 is now dispensing wire to a machine. The left-hand mounting plate 103 is now being prepared to deliver the next coil to the system. When one wishes to move in the next coil, the cables 98 and 99 are pulled to move the carriage 100 to the right, as shown in this Figure. In that way, the left-hand mounting plate 103 will now be aligned with shroud 21 and can dispense wire. Mounting plates 103 independently pivot, such that one may be loaded while the other is dispensing.

Figure 7:
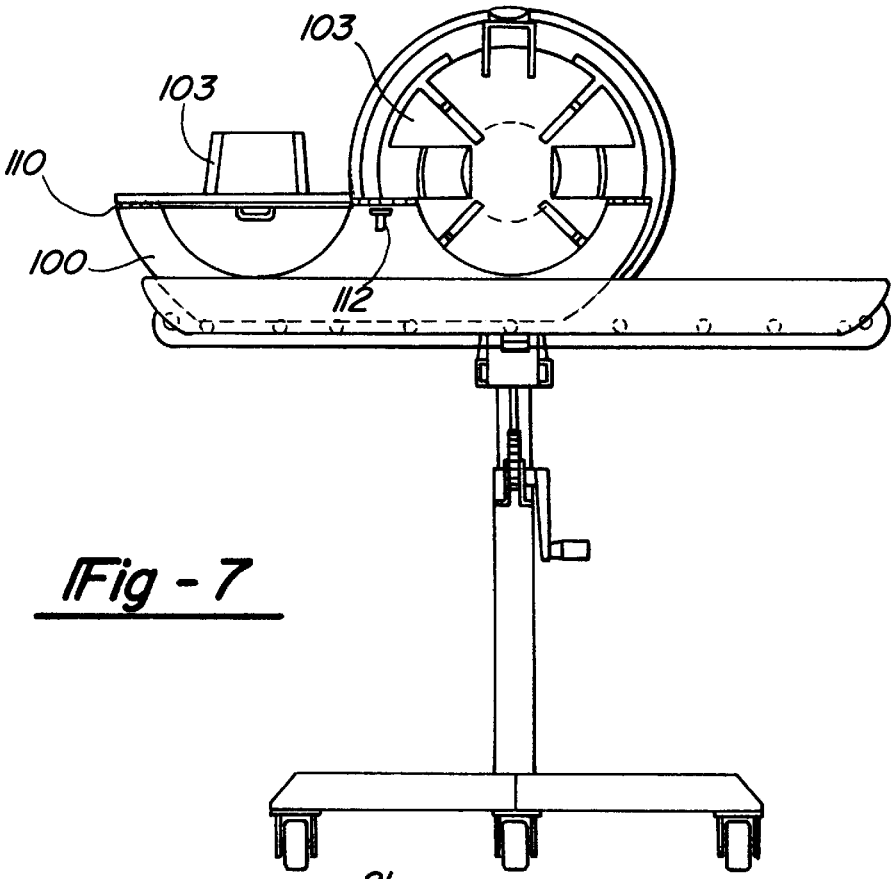
FIG. 7 shows a subsequent embodiment with a wire coil being loaded.

A splice slot 112 provides a control to shut the system down when the coil 111 that is being dispensed ends. This feature will be explained in more detail below. As shown in FIG. 7, the left-hand mounting plate 103 is pivoted to its loading position on hinge axis 110. The right-hand mounting plate 103 is still dispensing wire.

Figure 8:
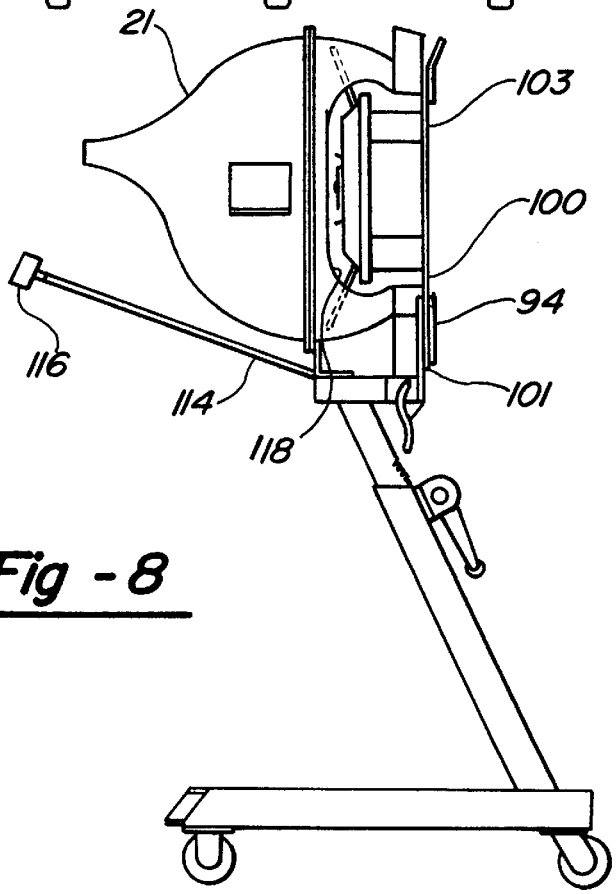
FIG. 8 is a side view of the FIG. 6 embodiment.

As shown in FIG. 8, the shroud 21 includes an enlarged opening 118 such that the mounting plates 103 and carriage 100 can move in the plane perpendicular to the central axis of the mandrels of the mounting plates 103.

In addition, handles 116 are shown at the end of tube 114. The cables 98 and 99 move from the pulley 96 through the tubes 104 and are connected to the handles 116. The handles may thus be conveniently pulled to shuttle the carriage 100 when changing the coil. Of course, power-driven shuttles may also be utilized. The details of the pulley system are not fully disclosed, however, a worker of ordinary skill in the art would be able to develop such details.

Figure 9A:
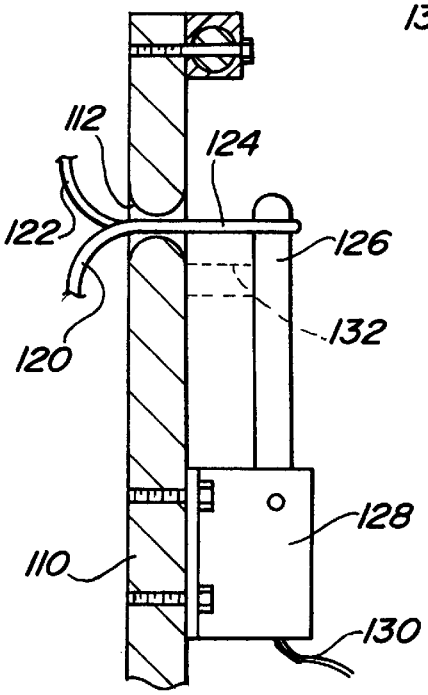
FIG. 9A shows a control detail of the FIG. 6 embodiment.
Figure 9B:
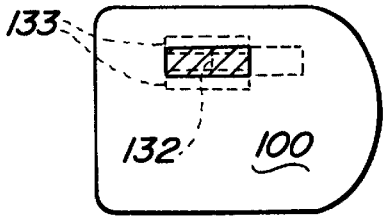
FIG. 9B shows a detail of the FIG. 9A control.

FIG. 9A shows a shut-off control for changing the wire. The end of a first wire 120 is spliced to the beginning of the next coil 122. The splice 124 is wrapped around a lever 126 on an opposed side of the splice slot 112 in the carriage 100. Lever 126 provides switch actuation in a microswitch 128. Thus, when the end 120 of the first coil pulls on the splice 124, the lever 126 moves to the left in this Figure. This movement activates the microswitch 128 and, through a wire 130, sends a signal to stop the motor of the cutting machine while the coil is changed. A sliding safety 132 slides along the plate 100 and provides a safety when one is initially putting the splice 124 on the lever 126, or changing either coil. With member 132 in the position shown in phantom in FIG. 9A, the lever 126 cannot move to the left and stop the system. As shown in FIG. 9B, sliding safety 132 may be simply mounted within guide slots 133 such that it may move to the blocking or safety position. The splices facilitate adding the new coil without having to rethread the cutting machine.

Figure 10:
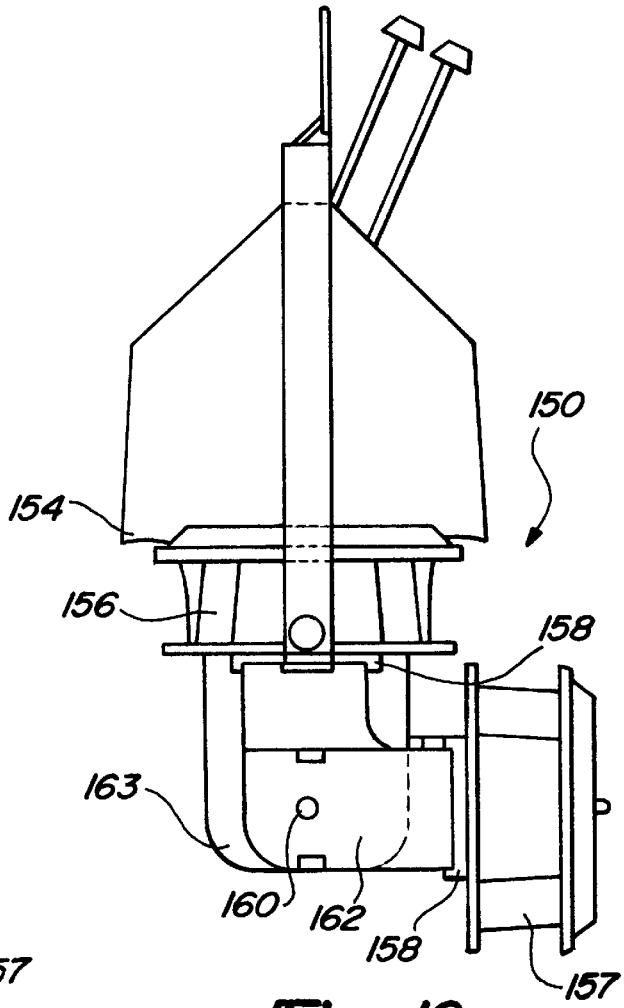
FIG. 10 shows yet another embodiment.

FIG. 10 shows another embodiment 150 of the system for changing wire. In this system, the shroud includes an enlarged opening 154 at its rear portion. A first mounting plate 156 is shown dispensing wire, while a second mounting plate 157 is shown spaced at approximately 90° from the dispensing mounting plate 156. Hinge axes 158 allow the mounting plates 156 to pivot relative to a frame 162. Frame 162 is mounted at a pivot point 160 within a lower base 163. The mounting plates 156 and 157 include the decelerator and other structure as explained above. With this system, when one wishes to change a coil, one pivots the plate 162 on axis 160 to bring the next coil into alignment with the shroud 152.

Figure 11:
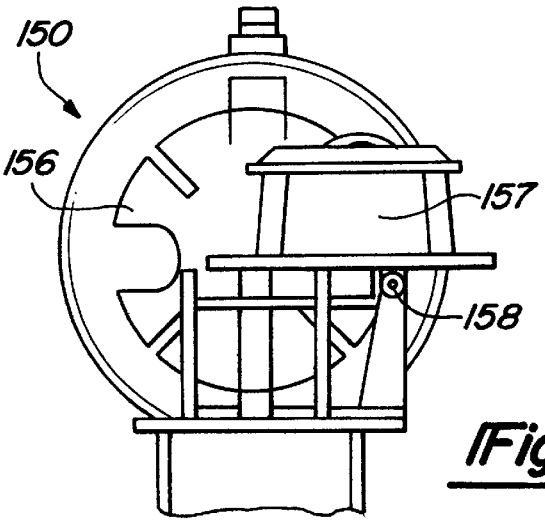
FIG. 11 shows the FIG. 10 embodiment in a loading position.

As shown in FIG. 11, the mounting plates,156 and 157 pivot on hinge axis 158 to allow loading. A structure similar to the splice slot and control mentioned above may also be incorporated into this embodiment.

Several embodiments of this invention have been disclosed. However, a worker of ordinary skill in the art would recognize that modifications of those embodiments would come within the scope of this invention. For that reason, the following claims should be studied to determine the true scope and content of this invention.

I claim:

1. An apparatus for dispensing wire comprising:

a shroud for enclosing a coil of wire, and having an eyelet for dispensing the wire;

at least two mounting plates including mandrels for mounting a coil; and a shuttle plate mounting said at least two mounting plates, said shuttle plate allowing shuttling of said two mounting plates into said shroud such that one of said mounting plates is dispensing wire within said shroud while a second of said mounting plates awaits movement into the shroud for dispensing.

2. An apparatus as recited in claim 1, wherein a control is included that stops dispensing of a wire when a coil which is being dispensed approaches an end of its wire.

3. An apparatus as recited in claim 2, wherein the end of a wire coil being dispensed is spliced to the beginning of a wire coil that is awaiting movement into said shroud, and said splice is mounted over a lever, said lever being moved to actuate a switch when an end of the coil approaches.

4. An apparatus as recited in claim 1, wherein said shuttle plate moves in a plane perpendicular to an axis of said mandrels when moving said mounting plates into said shroud.

5. An apparatus as recited in claim 4, wherein each of said mounting plates pivot with regard to said shuttle plate such that said mounting plate awaiting movement into said shroud may pivot to a generally horizontal orientation for loading a coil of wire.

6. An apparatus as recited in claim 1, wherein said shuttle plate pivots about a pivot axis, and said mounting plates are spaced at different circumferential locations relative to said pivot axis.

7. An apparatus as recited in claim 6, wherein said at least two mounting plates also pivot relative to said shuttle plate to allow one of said mounting plates to be moved to a loading location where it is generally horizontal.

8. An apparatus as recited in claim 1, wherein each of said mounting plates includes a decelerator flange mounted to said mandrel and on an opposed side of a coil.

9. An apparatus as recited in claim 8, wherein said eyelet of said shroud is offset relative to an axis of said mandrel which is dispensing wire.

10. A coil mounting plate for a wire coil payoff system comprising:

a backing plate and a mandrel extending forwardly of said backing plate;

a decelerator flange selectively attached to said mandrel for rotation relative to said mandrel, said decelerator flange including a plurality of resilent fingers extending radially outwardly of said accelerator flange to contact a wire leaving said mandrel, said resilient fingers extending from said decelerator flange and away from said mandrel and said backing plate such that said decelerator flange is positioned between said resilient fingers and said mandrel; and said mandrel having a plurality of slot at an outer peripheral surface, said slots facilitating movement of said bands onto a coil mounted on said mandrel for changing said coil.

11. An apparatus as recited in claim 10, wherein said slots also extend radially outwardly through said backing plate.

12. An apparatus as recited in claim 10, wherein said deceleration flange includes a rotating flange plate that is rotated by contact from a wire dispensed from said mandrel.

13. A method of dispensing wire including the steps of:

(1) providing a shroud having an eyelet for dispensing wire, providing at least two mounting plates for being mounted adjacent to said shroud, said mounting plates mounting a coil of wire to be dispensed, providing a shuttle plate mounting said at least two mounting plates;

(2) mounting coils of wire on each of said mounting plates, aligning one of said mounting plates with said shroud and dispensing wire; and (3) moving said shuttle plate to move one mounting plate away from said shroud and moving a second of said mounting plates adjacent to said shroud, and beginning to dispense wire from said second mounting plate.

14. A method as recited in claim 13, further including the steps of providing a switch to sense the end of the wire on said one mounting plate, said switch being operable to stop dispensing of said wire when said switch senses said one mounting plate is approaching the end of the wire on its coil.

15. A method as recited in claim 13, wherein said shuttle plate moves in a plane generally perpendicular to an axis of said coils.

16. A method as recited in claim 13, wherein said shuttle plate pivots on an axis, and said mounting plates are spaced at circumferential locations about said axis.

17. A method of changing wire on a wire dispensing plate comprising the steps of:

(1) providing a mounting plate with a mandrel, said mandrel having slots at outer peripheral surfaces;

(2) mounting a coil of wire on said mandrel, and dispensing wire from said coil; and (3) moving banding members through said slots to secure said coil and then removing said coil from said mandrel.

18. A method as recited in claim 17, further including the steps of providing said slots extending to the radially outer end of said mounting plate.

19. A method as recited in claim 17, wherein said bands are formed of hook and loop-type fasteners.

* * * * *